US010039386B2

(12) United States Patent
Hoff

(10) Patent No.: US 10,039,386 B2
(45) Date of Patent: Aug. 7, 2018

(54) BED FRAME ASSEMBLY

(71) Applicant: Floyd Design, LLC, Detroit, MI (US)

(72) Inventor: Kyle Hoff, Detroit, MI (US)

(73) Assignee: FLOYD DESIGN LLC, Detroit, MI (US)

( * ) Notice: Subject to any disclaimer, the term of this patent is extended or adjusted under 35 U.S.C. 154(b) by 0 days.

(21) Appl. No.: 15/349,932

(22) Filed: Nov. 11, 2016

(65) Prior Publication Data

US 2017/0135491 A1 May 18, 2017

Related U.S. Application Data

(60) Provisional application No. 62/254,452, filed on Nov. 12, 2015.

(51) Int. Cl.
*A47C 19/00* (2006.01)
*A47C 19/02* (2006.01)

(52) U.S. Cl.
CPC ..... *A47C 19/005* (2013.01); *A47C 19/024* (2013.01); *A47C 19/025* (2013.01)

(58) Field of Classification Search
CPC ... A47C 19/005; A47C 19/024; A47C 19/025; A47C 19/02; A47C 19/021
See application file for complete search history.

(56) References Cited

U.S. PATENT DOCUMENTS 969,501 A * 9/1910 Sleeth ..... A47C 19/025 5/207
971,867 A * 10/1910 Weppner ..... A47C 19/025 5/209
1,730,442 A * 10/1929 Wittliff ..... A47C 19/021 5/306
1,766,190 A * 6/1930 Rosenberg ..... A47C 19/025 248/214
2,452,645 A * 11/1948 Firsel ..... A47C 19/025 248/214
2,876,020 A * 3/1959 Murchie ..... A47C 19/024 280/79.11
2,886,832 A * 5/1959 Mitchell ..... A47C 19/025 5/236.1
3,553,745 A 1/1971 Sproll
3,748,668 A 7/1973 Rudin
4,027,343 A 6/1977 Hooker
4,354,287 A 10/1982 Fredman
4,617,689 A 10/1986 Nelson et al.
5,070,556 A * 12/1991 Gloger ..... A47C 17/86 16/35 R
5,469,589 A * 11/1995 Steed ..... A47C 19/005 5/201

(Continued)

OTHER PUBLICATIONS

International Search Report and Written Opinion issued in corresponding application No. PCT/US2016/061681 dated Mar. 2, 2017.

*Primary Examiner* — David E Sosnowski
(74) *Attorney, Agent, or Firm* — Foley & Lardner LLP

(57) ABSTRACT

A bed frame assembly includes a first planar member, a first end bracket, and a connecting member. The first planar member is configured to support a bed. The first end bracket is coupled to a side of the first planar member. The connecting member is detachably coupled to the first end bracket and is configured to secure the first end bracket to the first planar member.

20 Claims, 9 Drawing Sheets

(56) References Cited

U.S. PATENT DOCUMENTS 5,564,140 A * 10/1996 Shoenhair ..... A47C 19/021 403/397
5,996,145 A 12/1999 Taylor
7,003,822 B1 * 2/2006 Sheehy ..... A47C 19/005 5/200.1
8,028,362 B1 * 10/2011 Barreau ..... A47C 19/02 248/345.1
2003/0145379 A1 * 8/2003 Guillot ..... A47C 19/025 5/200.1
2007/0157388 A1 7/2007 Mossbeck et al.
2008/0052830 A1 * 3/2008 Koughan ..... A47C 19/005 5/613
2008/0235868 A1 * 10/2008 Snitzer ..... A47C 19/005 5/201
2009/0100597 A1 4/2009 Oh
2009/0183311 A1 * 7/2009 Nguyen ..... A47C 19/005 5/174
2010/0138993 A1 6/2010 Polevoy et al.
2010/0175186 A1 * 7/2010 Harrow ..... A47C 19/005 5/400
2011/0203050 A1 * 8/2011 Rogers ..... A47C 19/025 5/285
2012/0256467 A1 * 10/2012 Pettingill ..... A47C 23/06 297/452.55
2013/0025050 A1 * 1/2013 Syrowitz ..... A47C 19/025 5/246
2013/0098791 A1 * 4/2013 Saunders ..... A47C 19/005 206/326
2015/0208811 A1 * 7/2015 Polevoy ..... A47C 19/025 5/200.1
2015/0250325 A1 * 9/2015 Lee ..... A47C 19/12 5/202
2015/0320225 A1 * 11/2015 Boyd ..... A47C 19/04 5/202
2017/0135491 A1 * 5/2017 Hoff ..... A47C 19/005

* cited by examiner

BED FRAME ASSEMBLY

CROSS REFERENCE TO RELATED PATENT APPLICATIONS

This application claims the benefit of and priority to U.S. Provisional Application No. 62/254,452, filed Nov. 12, 2015, the entire disclosure of which is hereby incorporated by reference.

BACKGROUND

The present application relates generally to the field of bed frame assemblies. More specifically, this application relates to modular bed frame assemblies that are easy to assemble/disassemble.

Bed frame assemblies are typically sized based on the size of the bed (e.g., mattress, box spring, etc.) that is to be used with the bed frame assembly. For example, separate bed frame assemblies are made to accommodate king sized beds, queen sized beds, full sized beds, and twin sized beds. Thus, each bed frame assembly is not modular in nature and, therefore, cannot be used with beds of different sizes.

It would be advantageous to provide a bed frame assembly for supporting a bed that is modular in nature, includes a relatively few number of elements/components, and is easy to assemble/disassemble.

SUMMARY

One embodiment relates to a bed frame assembly. The bed frame assembly includes a first planar member, a first end bracket, and a connecting member. The first planar member is configured to support a bed. The first end bracket is coupled to a side of the first planar member. The connecting member is detachably coupled to the first end bracket and is configured to secure the first end bracket to the first planar member.

Another embodiment relates to a bed frame assembly including a first planar member, a first end bracket, and a connecting member. The first end bracket includes a base, a leg, and an arm. The first end bracket is coupled to a side of the first planar member. The base is configured to support the first planar member. The leg extends downwardly from the base and is configured to contact a support surface. The arm extends upwardly from the base and is configured to limit a relative movement between the first end bracket and the first planar member. The connecting member is detachably coupled to the first end bracket and is configured to secure the first end bracket to the first planar member.

Another embodiment relates to a bed frame assembly including a planar member, a first bracket, a second bracket, and a connecting member. The first bracket is removably coupled to a side of the planar member. The second bracket is removably coupled to an opposite side of the planar member. The connecting member is detachably coupled to the first and second brackets and is configured to secure the first and second brackets to the planar member upon tightening of the connecting member. The second bracket is configured to be removed from the planar member upon loosening of the connecting member to allow for one or more additional planar members to be added to the bed frame assembly so as to reconfigure the bed frame assembly.

In some exemplary embodiments, the bed frame assembly further comprises a second end bracket coupled to an opposite side of the first planar member. The connecting member is detachably coupled to the second end bracket and is configured to secure the first and second end brackets to the first planar member upon tightening of the connecting member.

In some exemplary embodiments, the bed frame assembly further comprises a second planar member positioned adjacent the first planar member, a first center bracket disposed between the first and second planar members to couple the first and second planar members together, and a second end bracket coupled to the second planar member. The connecting member is detachably coupled to the second end bracket. The connecting member is configured to secure the first and second end brackets to the first and second planar members, respectively, upon tensioning of the connecting member. In some exemplary embodiments, the first end bracket is coupled to an outer side of the first planar member and the second end bracket is coupled to an outer side of the second planar member.

In some exemplary embodiments, the bed frame assembly further comprises a second planar member positioned adjacent the first planar member, a third planar member positioned adjacent the second planar member, a first center bracket disposed between the first and second planar members to couple the first and second planar members together, a second center bracket disposed between the second and third planar members to couple the second and third planar members together, and a second end bracket coupled to the third planar member. The connecting member is detachably coupled to the second end bracket. The connecting member is configured to secure the first and second end brackets to the first planar member and third planar members, respectively, upon tightening of the connecting member. In some exemplary embodiments, the first end bracket is coupled to an outer side of the first planar member and the second end bracket is coupled to an outer side of the third planar member.

In some exemplary embodiments, the first end bracket comprises a base configured to support the first planar member, a leg extending downwardly from the base and configured to contact a support surface, and an arm extending upwardly from the base and configured to limit a relative movement between the first end bracket and the first planar member.

In some exemplary embodiments, the leg extends generally perpendicular to the base.

In some exemplary embodiments, the first end bracket further comprises a finger extending from the arm generally parallel to the base. The finger, the arm, and a portion of the base define a generally C-shaped section configured to receive and retain a portion of the first planar member.

In some exemplary embodiments, the first end bracket further comprises a foot disposed on an end of the leg. The foot is configured to rest on the support surface to support the bed frame assembly.

In some exemplary embodiments, the first end bracket further comprises a support extending between the foot and the base. The support, the base, and the leg cooperatively define a closed section to provide increased strength for supporting a load.

DETAILED DESCRIPTION

Referring generally to the FIGURES, disclosed in this application are bed frame assemblies that are configured having relatively few components (e.g., elements, members, etc.), that are easy to assemble and disassemble, and are modular in nature. By being modular in nature, the bed frame assemblies can be configured (or reconfigured) having a different number of planar members to accommodate different sized beds. For example, a bed frame assembly can be configured having two side by side planar members (e.g., two 22 inch wide planar members or panels) to be used with a twin bed sized bed (e.g., mattress, box spring, etc.). Also, for example, the bed frame assembly can be reconfigured having three side by side planar members to be used with a queen bed. Thus, one or more additional planar members and associated hardware (e.g., brackets) could be added to the original bed frame assembly to convert the assembly from a twin bed frame to a queen bed frame. Moreover, due to the simplicity of the assembly process, a skilled artisan is not required to assemble/disassemble the bed frame assembly. Additionally, the bed frame assemblies may be designed such that the assemblies may be disassembled and reassembled without the use of conventional tools (e.g., screw drivers, ratchets, sockets, etc.).

Figure 1:
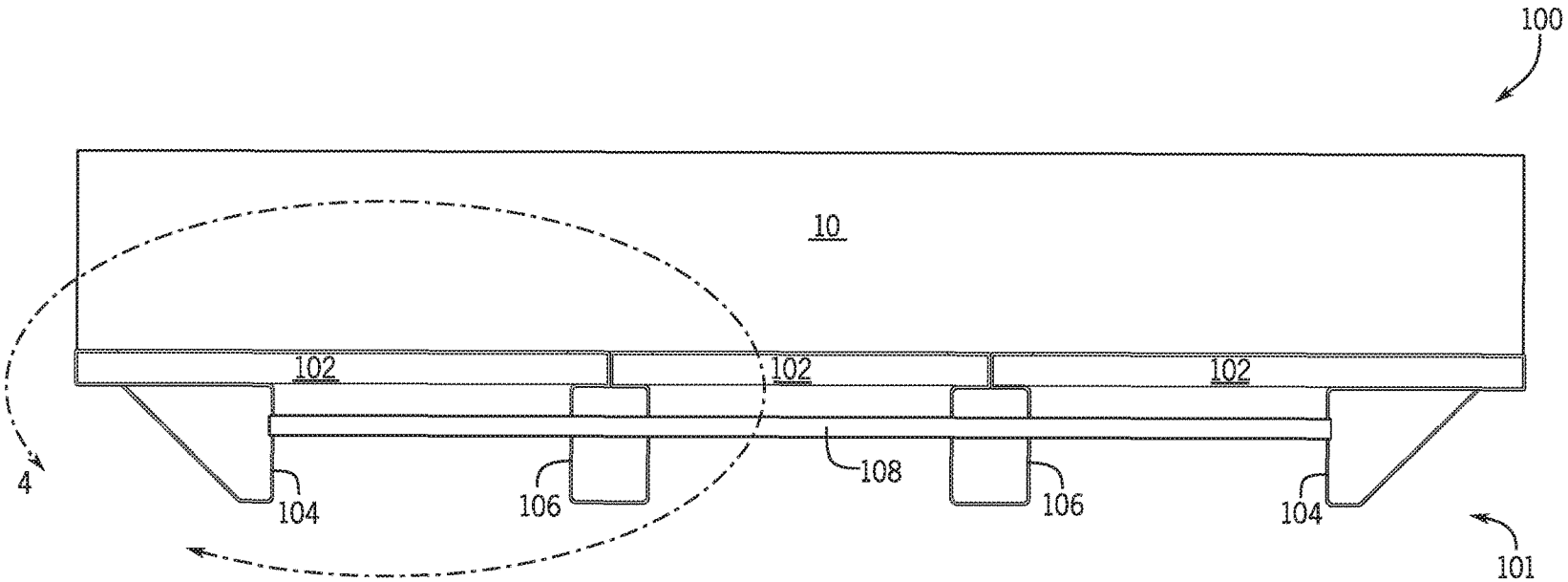
FIG. 1 is a side view of an exemplary embodiment of a bed assembly including a bed frame assembly, according to this application.

FIG. 1 illustrates an exemplary embodiment of a bed assembly 100 that includes a bed 10 on top of a bed frame assembly 101. The bed 10 may be configured according to any known size (e.g., twin, full, double, queen, king, etc.) and/or arrangement. According to an exemplary embodiment, the bed 10 includes a box spring and a mattress. According to other exemplary embodiments, the bed 10 includes only a mattress or other suitable member disposed on top of the bed frame assembly 101. The bed frame assembly 101 is configured to support the bed 10 disposed on top of the bed frame assembly. According to other exemplary embodiments, the bed frame assembly 101 may be configured as a support for other types of elevated surfaces or members, such as platforms, stages, or the like.

Figure 2:
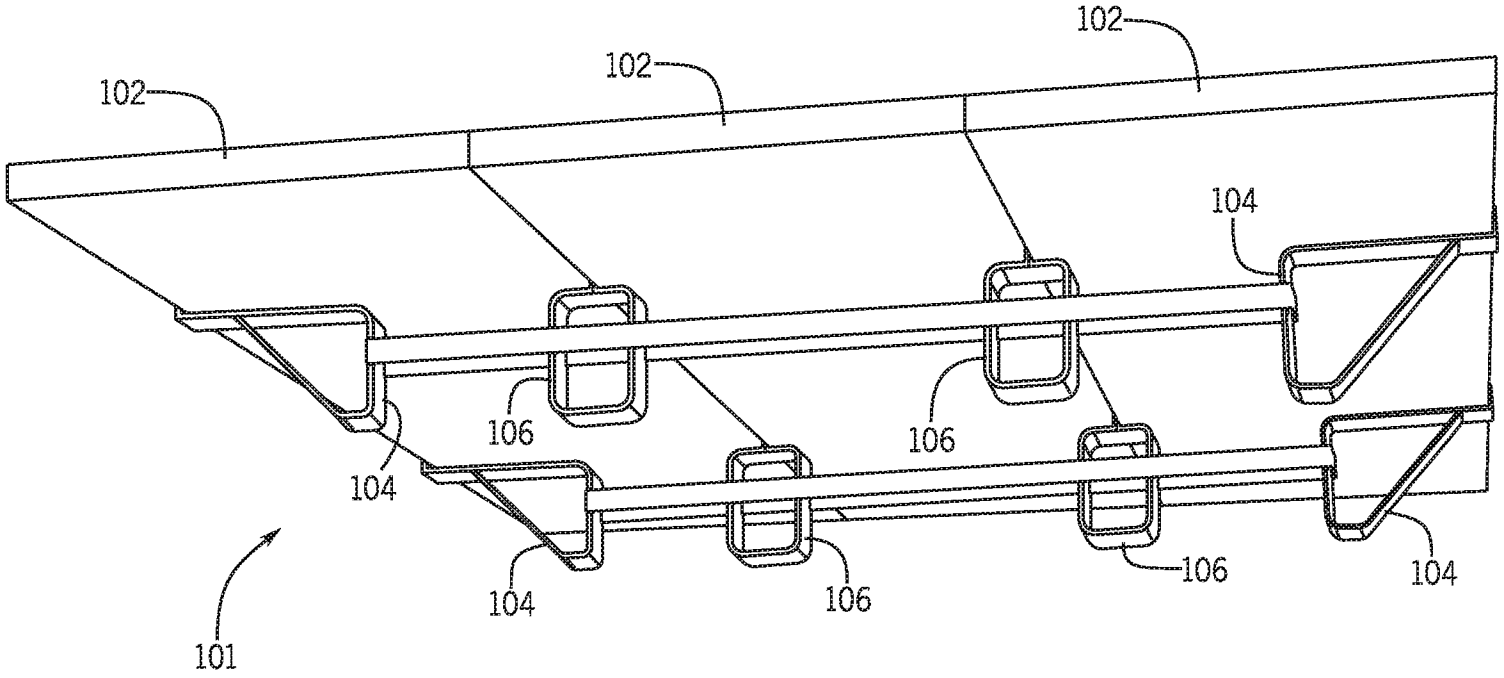
FIG. 2 is a bottom perspective view of an exemplary embodiment of a bed frame assembly for use with a bed assembly, such as the bed assembly shown in FIG. 1.
Figure 3:
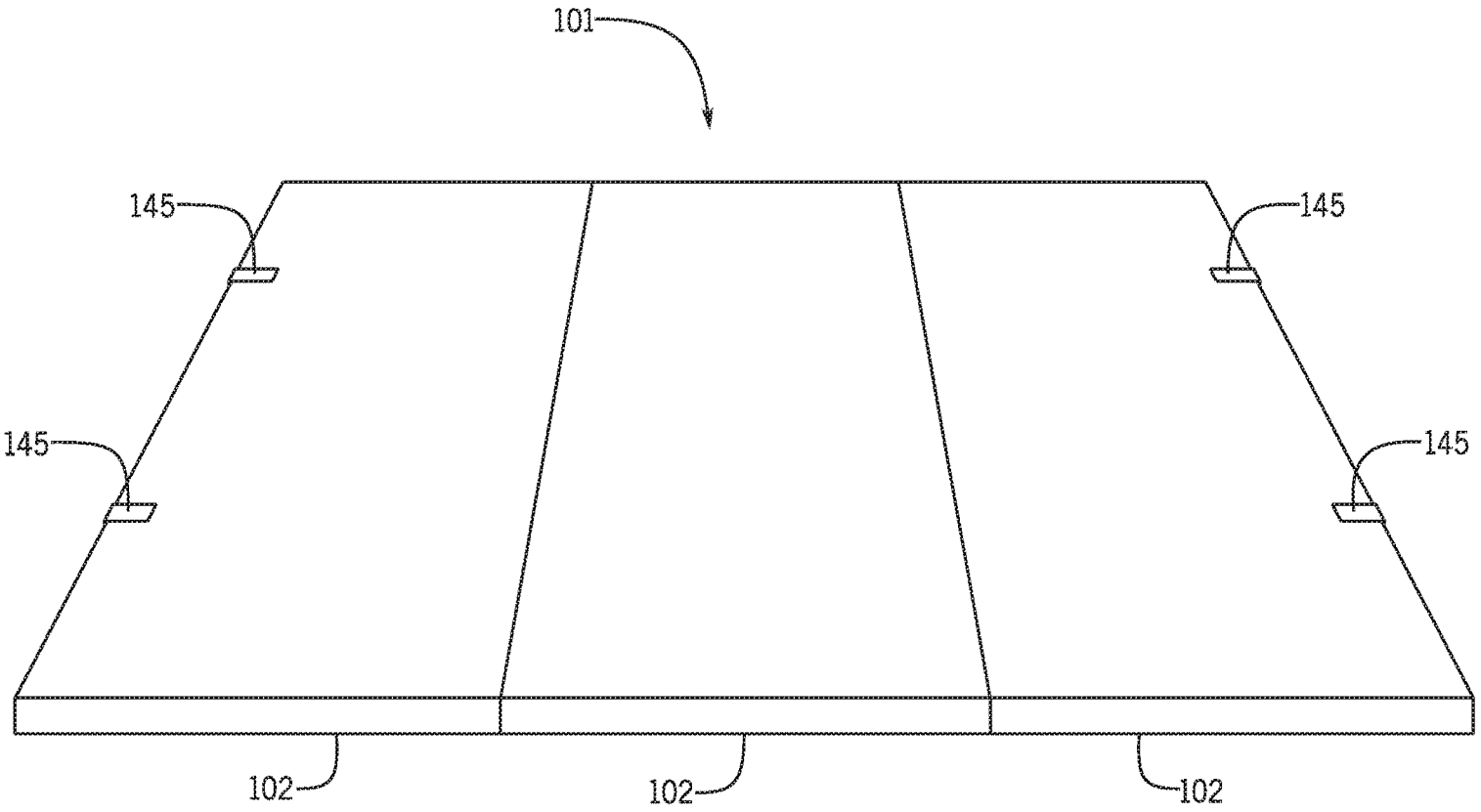
FIG. 3 is a top perspective view of the bed frame assembly shown in FIG. 2.

The bed frame assembly 101 includes one or more planar members, at least two brackets removably coupled to the one or more planar members, and at least one connecting member (e.g., a strap, a cable, a rod, etc.) that is configured to secure the assembly together, such as by securing two or more brackets to the one or more planar members. As shown in the embodiment of FIGS. 1-3, the bed frame assembly 101 includes three planar members 102 arranged in a side by side manner. As shown in FIG. 2, a first pair of brackets 104 may be disposed on an underside of the planar members and is offset from a second pair of brackets 106 that is also disposed on the underside of the planar members. The offset first and second pairs of brackets 104, 106 support the planar members 102, such as, for example, by resting on a support surface, such as a floor (or other surface), and having the planar members rest on the brackets.

Each planar member 102 may be configured the same, similar to, or different from any other planar member. For example, each planar member 102 may be configured having the same shape. As shown in FIGS. 2 and 3, each planar member 102 has a generally cuboidal shape (e.g., a rectangular planar member, a rectangular cuboid shape, etc.), with a length greater than a width, which is greater than a thickness. Each planar member 102 may have other suitable shapes, such as other polyhedron shapes. Also for example, each planar member 102 may be configured having the same size (e.g., thickness, width, and/or length) in order to provide modularity to the bed frame assembly. According to one non-limiting example, each planar member 102 is about 1.5 inches thick, about 22 inches wide, and 87 inches long. It is noted that these dimensions, as well as any others disclosed in this application, denote examples only and are not limiting.

Each planar member 102 may be made from any suitable material that is strong enough to withstand the loading during use. According to one example, each planar member 102 is a panel made from a sheet of material having a plurality of layers (e.g., piles, etc.), such as a plywood. Each planar member 102 may include more than one sheet of material, such as multiple sheets of plywood. According to another example, each planar member 102 includes a honeycomb material to advantageously provide a relatively lighter weight planar member (e.g., compared to a sheet of material). According to other exemplary embodiments, each planar member 102 includes slats, an open frame design, or the like.

Each of the brackets discussed above may include one or more end brackets 104 and/or one or more center brackets 106. As shown in FIG. 2, the bed frame assembly 101 includes two end brackets 104 and two center brackets 106. It is noted that a fewer number of brackets or additional brackets may be used with each bed frame assembly 101. For example, if the bed frame assembly 101 is configured having only two planar members 102, then the assembly may be configured having two end brackets 104 and one center bracket 106. The at least one planar member may include two planar members arranged in a side by side configuration with a first end bracket coupled to an outer side of one of the two planar members and a second end bracket coupled to an outer side of the other planar member. A center bracket may be disposed between an inner side of each of the two planar members to couple the two planar members together. If the bed frame assembly 101 is configured to include at least three planar members arranged in a side by side configuration, a first end bracket may be coupled to an outer side of one of the outer planar members and a second end bracket may be coupled to an outer side of the other outer planar member. A first center bracket may be provided between inner sides of the first and second adjacent planar members to interconnect the first and second adjacent planar members, and a second center bracket may be provided between inner sides of the second and third adjacent planar members to couple the second and third adjacent planar members. Also for example, if the bed frame assembly 101 is configured having four planar members 102, then the assembly may be configured having two end brackets 104 and three center brackets 106, and so forth.

Figure 4:
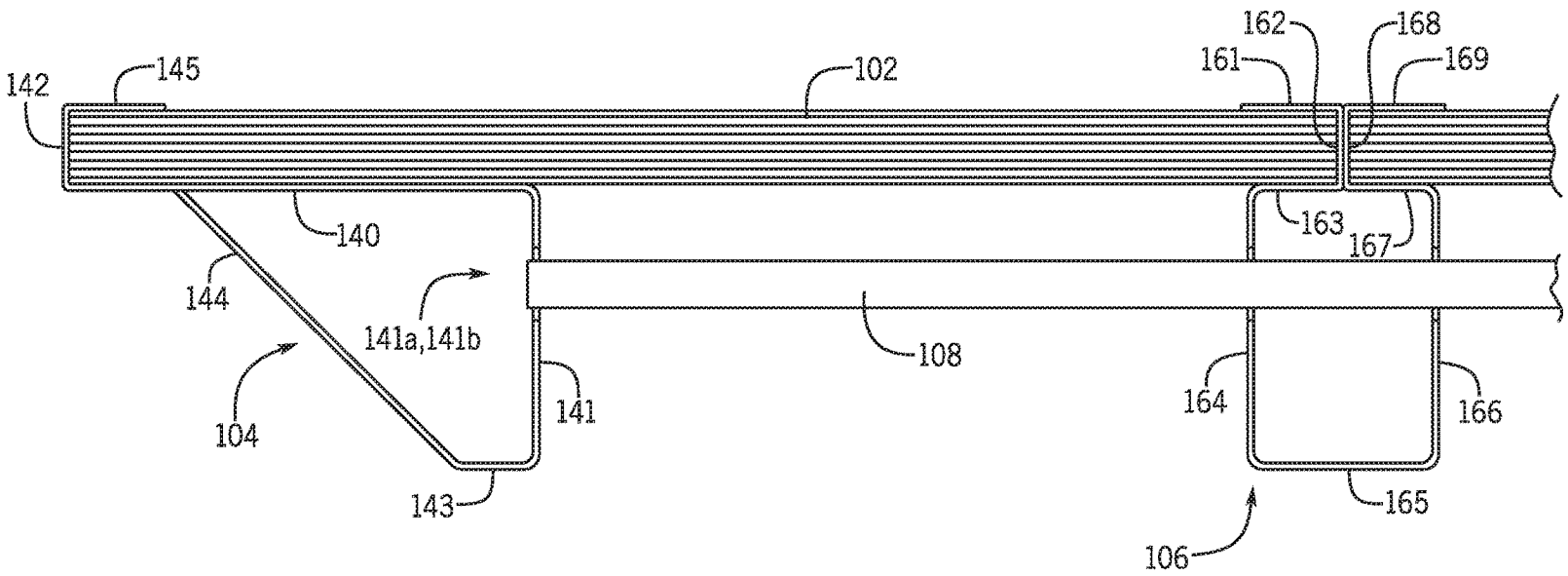
FIG. 4 is a side view of a portion of an exemplary embodiment of a bed frame assembly for use with a bed assembly, such as the bed assembly shown in FIG. 1.
Figure 6:
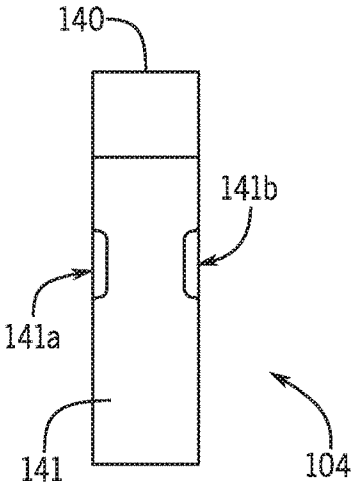
FIG. 6 is a front view of the end bracket shown in FIG. 5.
Figure 5:
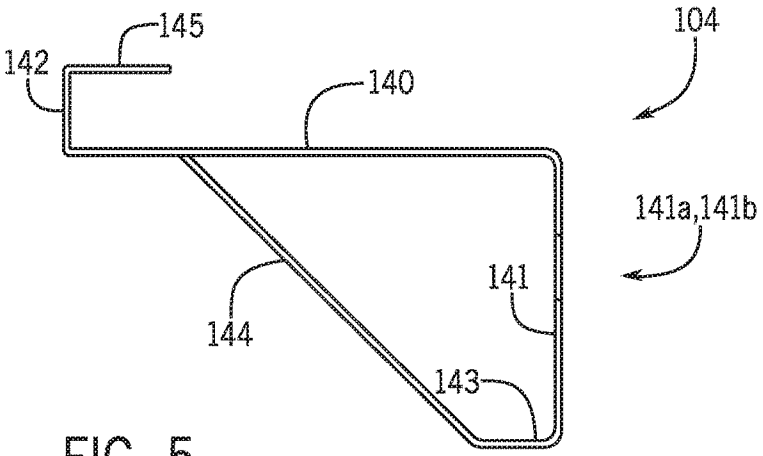
FIG. 5 is a side view of an exemplary embodiment of an end bracket for use with a bed frame assembly, such as the bed frame assembly shown in FIG. 4.
Figure 7:
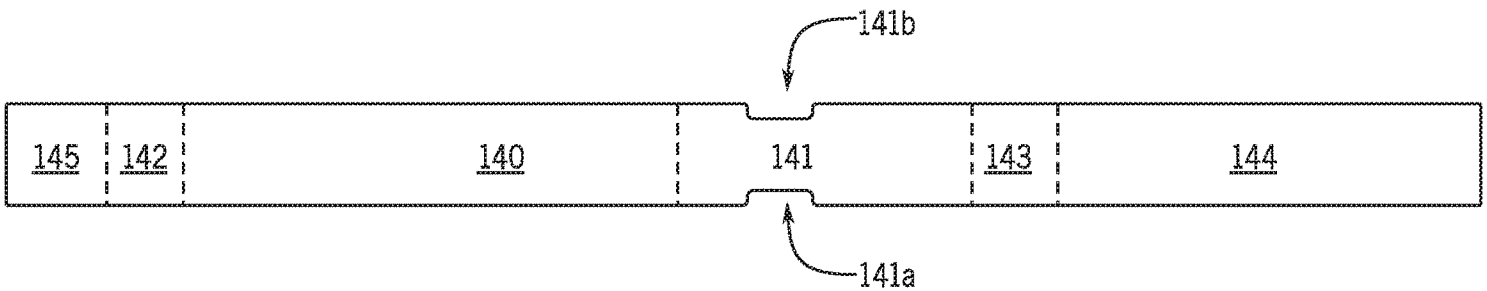
FIG. 7 is a plan view of a blank for use in forming the end bracket shown in FIG. 5.

Each end bracket 104 is configured to be removably coupled to an open end (e.g., an end that is not adjacent to or abutting another planar member) of one planar member 102 to support the one or more planar members of the bed frame assembly 101. FIGS. 4-7 illustrate an exemplary embodiment of an end bracket 104. FIGS. 4-6 illustrate the end bracket 104 in a formed configuration, while FIG. 7 illustrates the end bracket 104 prior to forming (i.e., as a blank of material). As shown, each end bracket 104 includes a base 140, a leg 141 extending downwardly from the base 140, and an arm 142 extending upwardly from the base 140. The base 140 of the end bracket 104 is configured to support an underside (e.g., bottom surface, etc.) of a planar member 102 of the assembly. For example, the base 140 may be a generally planar member that abuts the underside of a portion of one planar member 102 of the bed frame assembly 101.

As shown in FIGS. 5-7, each end bracket 104 may be a unitary member, such that the base 140, the leg 141, and the arm 142 are all integrally formed as a portion/part of the same single member. As shown in FIG. 7, the unitary end bracket 104 may be formed out of a flat blank (e.g., of a steel or other suitable metal) through any suitable forming process, such as a stamping process (e.g., using a progressive die, transfer die, or other suitable process). Utilizing a unitary end bracket 104, advantageously, eliminates/reduces the need for coupling members (e.g., fasteners) and/or coupling processes (e.g., welding), and also allows adding notches, holes (e.g., slots), or other useful features easily and inexpensively.

According to other examples, each end bracket 104 may include multiple elements that are coupled together. For example, one or more of the base 140, the leg 141, and the arm 142 may be separate from one or more of the other of the base 140, the leg 141, and the arm 142. The separate elements may be coupled together using a fastener (e.g., bolts, rivets, etc.), a process (e.g., welding), a combination thereof, or any other suitable element/process.

The leg 141 of the end bracket 104 extends downwardly from the base 140 to elevate the one or more planar members 102 relative to a support surface (e.g., floor, etc.) on which the bed frame assembly 101 sits. As shown in FIG. 4, the leg 141 extends generally perpendicular to the base 140. This arrangement may advantageously provide for a better connection between a connecting member (e.g., a tensioning element, a strap, a tie-down, a threaded rod, a cable, etc.) and one or more features of the two spaced apart legs 141 (see, for example, FIG. 1) for coupling and tensioning or tightening the connecting member to the end brackets 104. As shown in FIGS. 5 and 6, the leg 141 includes a pair of notches 141*a* and 141*b* located on opposite sides of the leg 141. Thus, a first (e.g., left) notch 141*a* extends into a first (e.g., left) side of the leg 141, and a second (e.g., right) notch 141*b* extends into a second (e.g., right) side of the leg 141. The size (e.g., width or height, depth, etc.) of each notch may be tailored to the size of the connecting member. For example, a connecting member shown as a strap 108 (e.g., a ratchet strap, a cable strap, a fabric strap, a non-adjustable strap, etc.) may be used with the bed frame assembly 101, and the height of each notch may be tailored to accommodate the height of the strap 108 and/or the depth of each notch may be tailored to accommodate the thickness of the strap 108.

A foot 143 may be disposed on an end of the leg 141 that is opposite the end of the leg 141 connected to the base 140. The foot 143 is configured to rest on another surface to support the bed frame assembly 101. According to one example, the foot 143 is configured generally parallel to the base 140 and generally perpendicular to the leg 141. According to other examples, the foot 143 may be configured at an angle relative to the base 140 and/or the leg 141.

The end bracket 104 may include a support 144 disposed on an end of the foot 143 that is opposite the end of the foot 143 connected to the leg 141. The support 144 may be configured to extend between the foot 143 and the base 140. As shown in FIG. 4, the support 144 extends between an end of the foot 143 and the base 140 at a first angle relative to the foot 143 and at a second angle relative to the base 140. Thus, the support 144 in combination with the base 140, the leg 141, and the foot 143 may cooperatively define a closed section to provide a stronger end bracket 104 that is able to support relatively higher loads (e.g., weight) from the bed frame assembly 101, the bed provided thereon, as well as weight from other objects (e.g., people, pets, etc.) that may be on the bed. In other words, the closed section may provide increased strength for the end bracket 104 to support a load (e.g., people, pets, etc.). As shown in FIGS. 5 and 7, the end of the support 144 may be coupled to a bottom portion of the base 140, such as, for example, by welding (e.g., MIG welding, TIG welding, etc.) the support (e.g., an end thereof) to the base.

The arm 142 of the end bracket 104 is configured to extend upwardly from the base 140, such as to be provided adjacent to an open end or side of a planar member 102 (FIGS. 1 and 4). For example, the arm 142 may be configured to abut an open side of the planar member 102 supported by the base 140. As shown, the arm 142 may extend generally perpendicular to the base 140. However, the arm 142 can be configured to extend at an angle relative to the base 140, according to other examples. The length of the arm 142 may be tailored to the size (e.g., height) of the one or more planar members 102 of the bed frame assembly 101. The arm 142 also limits travel or relative movement of the planar member 102 being supported by the end bracket 104 in the direction toward the arm.

A finger 145 may be disposed on an end of the arm 142 that is opposite the end of the arm 142 connected to the base 140. The finger 145 is configured to receive and retain the open end of the planar member 102 that is resting on the base 140. As shown in FIG. 4, the finger 145 may extend generally parallel to the base 140 (and generally perpendicular to the arm 142) in an inwardly direction (e.g., back over the planar member 102 and the base 140). Thus, the finger 145 in combination with the arm 142 and a portion of the base 140 define a generally C-shaped (e.g., C-shape with curved or rounded corners, C-shape with square corners, U-shape, etc.) section that is configured to receive and help retain a portion of a side or end of the planar member 102. This C-shape also helps couple the end bracket 104 and the planar member 102 together. According to an exemplary embodiment, the C-shaped section has a size and inner profile that is complementary to an outer profile of the planar member 102, such that at least a portion of the planar member 102 can be received and retained within the C-shaped section. According to other exemplary embodiments, the C-shaped section can be configured having a different size and profile to receive other sized planar members (e.g., planar members having different thicknesses, different shapes, etc.). According to other exemplary embodiments, the arm 142 and/or the finger 145 may be adjustable relative to the base 140 such that the C-shaped section can receive a variety of different sized planar members (e.g., planar members having different thicknesses, etc.). According to an exemplary embodiment, the arm 142 and/or the finger 145 can each include an opening to allow for the end bracket 104 to be coupled directly to a planar member by, for example, using bolts, screws, or other types of fasteners. In this way, the bed frame assembly 101 can be used without a connecting element, such as a strap.

Figure 9:
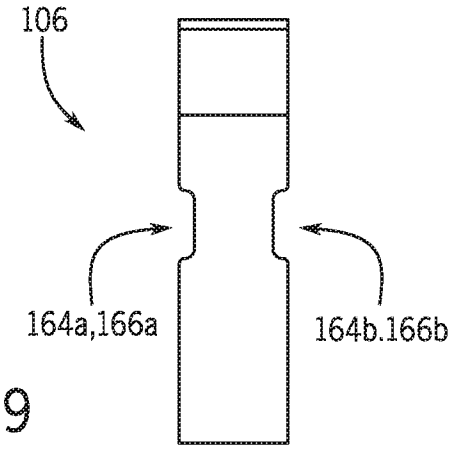
FIG. 9 is a front view of the center bracket shown in FIG. 8.
Figure 8:
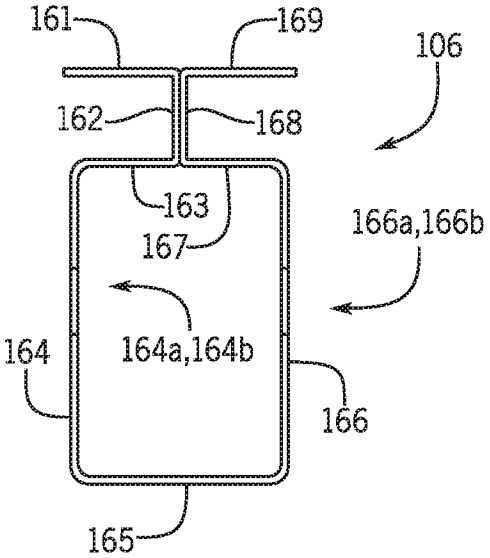
FIG. 8 is a side view of an exemplary embodiment of a center bracket for use with a bed frame assembly, such as the bed frame assembly shown in FIG. 4.
Figure 10:
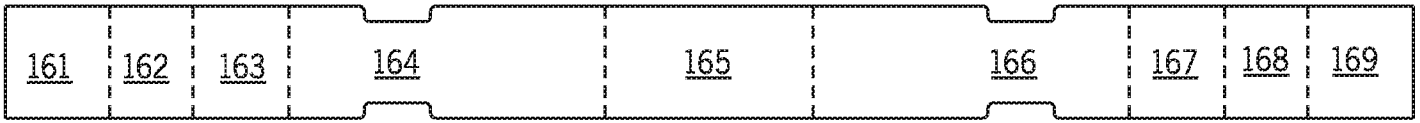
FIG. 10 is a plan view of a blank for use in forming the center bracket shown in FIG. 8.

Each center bracket 106 is configured to be removably coupled between two adjacent planar members 102 to support the two planar members 102 of the bed frame assembly 101. In other words, each end bracket 106 is configured to be coupled to a closed end (e.g., the end adjacent to an end of another planar member) of each of two adjacent planar members 102. FIGS. 4 and 8-10 illustrate an exemplary embodiment of a center bracket 106. FIGS. 4, 8, and 9 illustrate the center bracket 106 in a formed configuration, while FIG. 10 illustrates the center bracket 106 prior to forming (i.e., as a blank of material). As shown, each center bracket 106 includes a first base 163, a first leg 164 extending downwardly from the first base 163, a first arm 162 extending upwardly from the first base 140, a second base 167, a second leg 166 extending downwardly from the second base 167, and a second arm 168 extending upwardly from the second base 167. According to an exemplary embodiment, the arms 162, 168 can each include an opening to allow for the center bracket 106 to be coupled directly to a planar member by, for example, using bolts, screws, or other types of fasteners. In this way, the bed frame assembly 101 can be used without a connecting element, such as a strap.

As shown in FIGS. 4 and 8-10, each center bracket 106 may be a unitary member, such that each base, each leg, and each arm are all integrally formed as a portion/part of the same single member. As shown in FIG. 10, the unitary center bracket 106 may be formed out of a flat blank (e.g., of a steel or other suitable metal) through any suitable forming process, such as stamping process (e.g., using a progressive die, transfer die, or other suitable process).

According to other examples, each center bracket 106 may include multiple elements that are coupled together. For example, one or more of the bases, the legs, and/or the arms may be separate elements, which may be coupled together using one or more fasteners (e.g., bolts, rivets, etc.), one or more processes (e.g., welding, such as MIG, TIG, etc.), a combination thereof, or any other suitable element/process.

The first base 163 of the center bracket 106 is configured to support an underside (e.g., bottom surface) of one planar member 102, and the second base 167 of the center bracket 106 is configured to support an underside of another planar member 102. For example, the first base 163 may be a generally flat member that abuts the underside of a first planar member 102, and the second base 167 may be a generally flat member that abuts the underside of a second planar member 102. The first and second bases 163, 167 may be provided adjacent to one another, such as to support two adjacent planar members 102 of the assembly. According to one example, the first and second bases 163, 167 are generally coplanar members to advantageously align the two adjacent planar members 102 at the same height or elevation.

Each of the first and second legs 164, 166 of the center bracket 106 is configured to extend downwardly from the associated (e.g., respective) base 163, 167 to elevate the one or more planar members 102 relative to a support surface (e.g., floor) on which the bed frame assembly 101 sits. For example, the height that each center bracket 106 elevates the one or more planar members 102 advantageously is the same height that each end bracket 104 elevates the one or more planar members 102 to provide a uniform height of the bed frame assembly 101. As shown in FIGS. 4 and 8, each leg 164, 166 extends generally perpendicular to the associated base 163, 167. As shown in FIGS. 8 and 9, each leg 164, 166 includes a pair of notches 164*a*, 164*b*, 166*a*, 166*b* located on opposite sides of the leg 164, 166. Accordingly, a first (e.g., left) notch 164*a* extends into a first (e.g., left) side of the first leg 164, and a second (e.g., right) notch 164*b* extends into a second (e.g., right) side of the first leg 164. Also, a first (e.g., left) notch 166*a* extends into a first (e.g., left) side of the second leg 166, and a second (e.g., right) notch 166*b* extends into a second (e.g., right) side of the second leg 166. Each notch is configured to receive a portion of a connecting member. Thus, the size (e.g., width or height, depth, etc.) of each notch may be tailored to the size of the fixing member to be received by the notch. For example, if a strap 108 is used with the bed frame assembly 101, the height of each notch may be tailored to accommodate the height of the strap 108 and/or the depth of each notch may be tailored to accommodate the thickness of the strap 108.

Each center bracket 106 may also include a foot 165 extending between a bottom (e.g., lower) end of the first leg 164 and a bottom end of the second leg 166. Thus, the foot 165 includes a first end connected to the bottom end of the first leg 164 and a second end connected to the bottom end of the second leg 166. The foot 165 is configured to rest on another surface (e.g., a support surface, etc.) to support the bed frame assembly 101. The foot 165 may include a flat portion that is configured to rest on a support surface. According to one example, the foot 165 is configured generally parallel to the first base 163 and/or the second base 167. The foot 165 may be configured generally perpendicular to the associated leg 164, 166. According to other examples, the foot 165 may be configured at an angle relative to the first base 163, the second base 167, the first leg 164, and/or the second leg 166.

Each of the first and second arms 162, 168 of the center bracket 106 is configured to extend upwardly from the associated (e.g., respective) base 163, 167, such as to be provided adjacent to a side of one of the planar members 102 (FIGS. 1 and 4). For example, each arm 162, 168 may be configured to abut an end or side of the planar member 102 supported by the associated base 163, 167 of the center bracket 106. As shown, each arm 162, 168 extends generally perpendicular to the associated base 163, 167. However, each arm 162, 168 may be configured to extend at an angle relative to the associated base 163, 167, according to other examples. The length of each arm 162, 168 may be tailored to the size (e.g., height) of the one or more planar members 102 of the bed frame assembly 101. For example, multiple planar members 102 may be stacked on top of each other, and the length of each arm may be increased to accommodate the additional planar members.

The first and second arms 162, 168 of the center bracket 106 may be coupled together. As shown in FIGS. 8 and 10, the first and second arms 162, 168 are configured to abut one another and are coupled together by a welding process (e.g., spot welding, laser welding, etc.). However, fasteners, as well as other suitable coupling members and/or types of processes may be used to couple the first arm 162 and the second arm 168 together.

Each center bracket 106 may also include finger 161, 169 disposed on an upper end of each arm 162, 168. As shown in FIGS. 4 and 8, a first finger 161 extends outwardly away from the first arm 162, and a second finger 169 extends outwardly away from the second arm 168. Thus, the first and second fingers 161, 169 extend outwardly away from each other. Each finger 161, 169 is configured to help retain an end of the planar member 102 of the bed frame assembly 101 that is resting on the associated base 163, 167. As shown in FIG. 4, each finger 161, 169 may extend generally parallel to the associated base 163, 167 (and generally perpendicular to the associated arm 162, 168) in an outward direction (e.g., back over the associated planar member 102 and the associated base 163, 167). Thus, the first finger 161 in combination with the first arm 162 and the first base 163 define a generally first C-shaped section that is configured to receive a portion of a side or end of a first planar member 102, and the second finger 169 in combination with the second arm 168 and the second base 167 define a generally second C-shaped section that is configured to receive a portion of a side or end of a second planar member 102. These C-shape sections help couple the center bracket 106 and the two planar members 102 together. Accordingly, two adjacent planar members 102 may be retained and supported by each center bracket 106. According to an exemplary embodiment, the fingers 161, 169 can each include an opening to allow for the center bracket 106 to be coupled directly to a planar member by, for example, using bolts, screws, or other types of fasteners. In this way, the bed frame assembly 101 can be used without a connecting element, such as a strap.

As noted above, the bed frame assembly 101 includes at least one connecting member (e.g., a tensioning member, a strap, a ratchet strap, a cable, a threaded rod, etc.) that is configured to help secure the various brackets (e.g., end bracket, center bracket, etc.) and planar members of the bed frame assembly 101 together. As shown in FIGS. 1 and 4, the bed frame assembly 101 includes a connecting member in the form of a strap 108 (e.g., a ratchet strap, a non-adjustable strap, a cable strap, etc.) that is configured to apply a varying degree of tension between two end brackets 104 to secure the bed frame assembly 101 together. In other words, the tensioning provided by the strap 108 can be increased (e.g., tightened) to prevent the brackets and planar members of the bed frame assembly 101 from becoming decoupled, and the tensioning provided by the strap 108 can be decreased (e.g., loosened), such as to allow decoupling the brackets and planar members to disassemble the bed frame assembly 101 so as to, for example, add additional planar members 102 to the bed frame assembly 101 to change the configuration of the bed. The strap 108 may be made from a flexible material that is durable and strong, such as, for example, a relative high-strength woven nylon material. The strap 108 may also include a locking (e.g., clamping) member, such as a buckle, a clamp, or any other suitable device, to selectively secure the strap 108 in place. For example, as the strap is tensioned against the brackets and planar members of the system, the relative position/configuration of the strap may be selectively locked or clamped in order to secure the assembly and maintain the relative tension.

The bed frame assembly 101 may include more than one connecting member. For example, the bed frame assembly 101 may include one strap 108 for each pair of brackets (e.g., having two straps 108 for use with the two pairs of brackets shown in FIG. 2). As shown in FIGS. 1 and 4, each strap 108 is configured to extend between and be coupled to the two end brackets 104, such that a tension from the strap 108 into the end brackets 104 may be adjusted (e.g., increased, decreased). Each strap 108 may engage the notches in each end bracket 104. Additionally, each strap 108 may pass through the notches of each center bracket 106.

FIGS. 11-17 illustrate another exemplary embodiment of a bed frame assembly 201 for use with a bed assembly. For example, the bed frame assembly 201 may be used with the bed 10 or any other suitable bed. The bed frame assembly 201 is similar to the bed frame assembly 101 in that each bed frame assembly is configured to include one or more brackets configured to support one or more planar members 102. By way of non-limiting examples, the bed frame assembly 201 may include two or more end brackets 204. Also by way of non-limiting examples, the bed frame assembly 201 may include one or more center brackets 206. The bed frame assembly 201 may include two or more pairs of brackets, where each pair of brackets includes two end brackets 204 and at least one center bracket 206.

Figure 11:
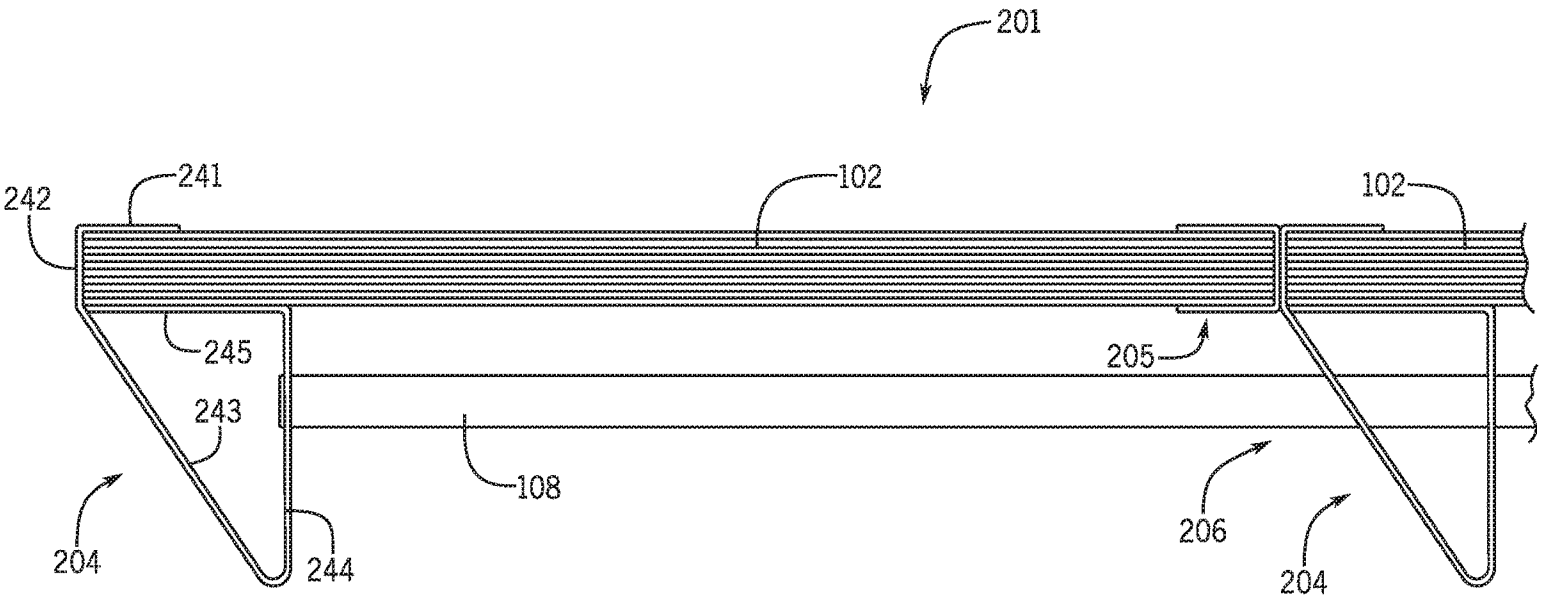
FIG. 11 is a side view of a portion of another exemplary embodiment of a bed frame assembly for use with a bed assembly, such as the bed assembly shown in FIG. 1.
Figure 13:
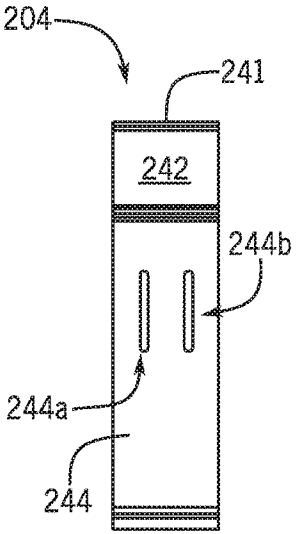
FIG. 13 is a front view of the end bracket shown in FIG. 12.
Figure 14:
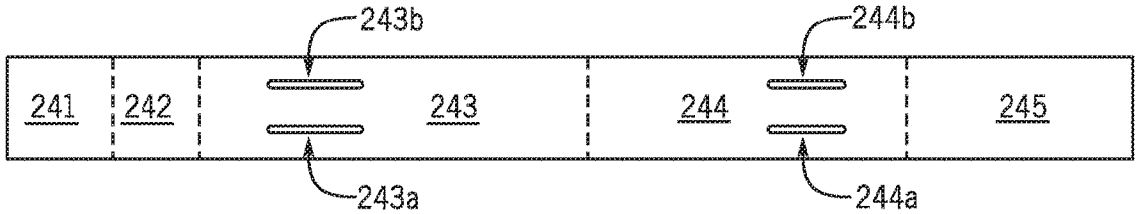
FIG. 14 is a plan view of a blank for use in forming the end bracket shown in FIG. 12.
Figure 12:
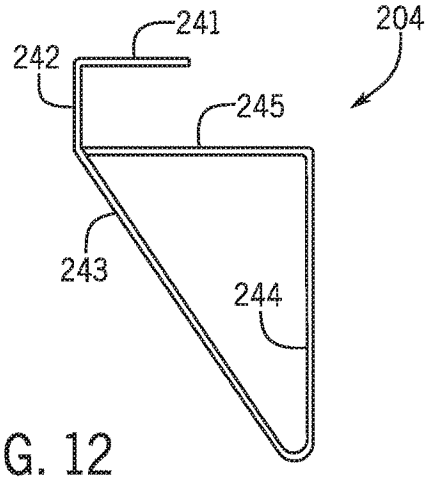
FIG. 12 is a side view of another exemplary embodiment of an end bracket for use with a bed frame assembly, such as the bed frame assembly shown in FIG. 11.

Each end bracket 204 of the bed frame assembly 201 is configured to be coupled to (e.g., receive and support) a side or an end of one of the one or more planar members of the bed frame assembly 201. FIGS. 11-14 illustrate an exemplary embodiment of an end bracket 204. FIGS. 11-13 illustrate the end bracket 204 in a formed configuration, while FIG. 14 illustrates the end bracket 204 prior to forming (i.e., as a blank of material). As shown, each end bracket 204 includes a base 245, a leg 244 extending downwardly from the base 245, a support 243 extending between the base 245 and the leg 244, an arm 242 extending upwardly from the support 243, and a finger 241 extending from an upper end of the arm 242. However, it is noted that each end bracket 204 may include a fewer number of these elements or additional elements.

Each end bracket 204 may be a unitary member, such that the base 245, the leg 244, the support 243, the arm 242, the finger 241 are all integrally formed together. As shown in FIG. 14, the unitary end bracket 204 may be formed out of a flat blank (e.g., of a steel or other suitable metal) through any suitable forming process, such as stamping process (e.g., using a progressive die, transfer die, or other suitable process).

According to other examples, each end bracket 204 may include multiple elements that are formed separately and then coupled together after forming of the elements. For example, the base 245, the leg 244, the support 243, the arm 242, and/or the finger 241 may be formed separately, and then coupled to one or more of the other elements, such as using one or more fasteners (e.g., bolts, rivets, etc.), a process (e.g., welding), a combination thereof, or any other suitable process or coupling member.

The base 245 of the end bracket 204 is configured to support an underside (e.g., bottom surface) of the planar member 102. For example, the base 245 may be a generally flat member that abuts and supports the underside of the planar member 102. As shown in FIG. 14, the base 245 is generally rectangular in shape and includes an end that is configured to be fixedly coupled to the arm 242, such as by welding (e.g., MIG welding, laser welding, etc.).

The leg 244 of the end bracket 204 is configured to extend downwardly from an end of the base 245 to elevate the base 245 (and the one or more planar members 102 supported by the base) relative to a surface (e.g., floor) on which the end bracket 204 rests on. As shown in FIG. 12, the leg 244 extends generally perpendicular to the base 245, which may advantageously provide for a better connection between the a fixing member and the leg 244. As shown in FIGS. 13 and 14, the leg 244 includes a pair of spaced apart slots 244*a* and 244*b* (e.g., slotted holes) extending through the entire thickness of the leg 244. The slots 244*a*, 244*b* are configured to receive a fixing member, such as a tensioning strap to help secure bed frame assembly 201 together. Alternatively, the leg 244 may include notches (e.g., as disclosed above with respect to the end bracket 104) in place of (or in addition to) the slots. Similarly, the end bracket 104 may be configured having slots in place of (or in addition to) the notches. The size (e.g., width or height, depth, etc.) of each slot/notch of each end bracket may be tailored to the size of the fixing member. For example, a height of each slot/notch of each end bracket (e.g., end bracket 104, end bracket 204) may be tailored to accommodate the height of the strap 108, and/or a width of each slot/notch of each end bracket may be tailored to accommodate the thickness of the strap 108.

The support 243 of the end bracket 204 is configured to extend between the arm 242 and the leg 244 of the end bracket 204. For example, the support 243 may extend between a lower end of the arm 242 (e.g., approximately where the base 245 meets the arm 242) and a bottom end of the leg 244 (that is opposite to the top end of the leg 244 connected to the base 245). The support 243 may extend at a first angle relative to the base 245 and at a second angle relative to the leg 244. Thus, the support 243, the leg 244, and the base 245 generally may form a closed section (e.g., having a generally triangular shape) to provide a stronger end bracket 204 that is able to support relatively higher loads (e.g., weight) from the bed frame assembly 201, the bed provided thereon, as well as weight from other objects (e.g., people, pets, etc.) that may be on the bed. The support 243 may be configured having a pair of spaced apart slots 243*a* and 243*b* (e.g., slotted holes) extending through the entire thickness of the support 243 (e.g., as shown in FIGS. 13 and 14). The slots 243*a*, 243*b* in the support 243 may receive a fixing member, such as a tensioning strap to help secure bed frame assembly 201 together. Alternatively, the support 243 may include notches (e.g., as disclosed above with respect to the end bracket 104) in place of (or in addition to) the slots.

The support 243 and the leg 244 may form a foot that is configured to contact a support surface (e.g., floor) when the bed frame assembly 201 rests on the support surface. Thus, the foot is configured to contact (e.g., rest on) the support surface to support the bed frame assembly 201. According to one example, the foot is a transition between the support 243 and the leg 244. For example, the foot may be a curved (e.g., radius, filleted, etc.) portion extending between the generally flat support 243 and the generally flat leg 244. The foot may be configured differently, such as, for example, having a flat portion that is provided parallel to the base 245, according to other examples. Also, for example, the support 243 and the leg 244 may meet at a sharper edge forming the foot.

The arm 242 of the end bracket 204 is configured to extend upwardly from the support 243, such as to be located adjacent to a side of a planar member 102 when the bed frame assembly 201 is assembled (see FIG. 11). For example, the arm 242 may be configured to abut an outer surface of a side or an end of the planar member 102 supported by the base 245 of the end bracket 204. As shown, the arm 242 may extend generally perpendicular to the base 245. However, the arm 242 can be configured to extend at an angle relative to the base 245, according to other examples. The length of the arm 242 may be tailored to the size (e.g., height) of the one or more planar members 102 of the bed frame assembly 201. As shown in FIGS. 12 and 14, the end of the base 245 (opposite to the end connected to the leg 244) may be fixedly coupled to an inside surface of the arm 242 by welding.

The finger 241 of the end bracket 204 may be configured to extend inwardly from an end of the arm 242. For example, the finger 241 may be disposed on (and extend from) an upper end of the arm 242 that is opposite the end (of the arm 242) connected to the support 243. The finger 241 is configured to help retain an end of the planar member 102 that is resting on the base 245. As shown in FIG. 12, the finger 241 may extend generally parallel to the base 245 (and generally perpendicular to the arm 242) in an inwardly direction (e.g., back over the planar member 102 and the base 245) a distance that is less than a length of the base 245. Thus, the finger 241 in combination with the arm 242 and at least a portion of the base 245 may be configured to form a generally C-shaped section that is configured to receive a portion of a side or end of a planar member 102 of the bed frame assembly. The C-shaped section advantageously helps secure the bed frame assembly 201 when assembled.

Figure 16:
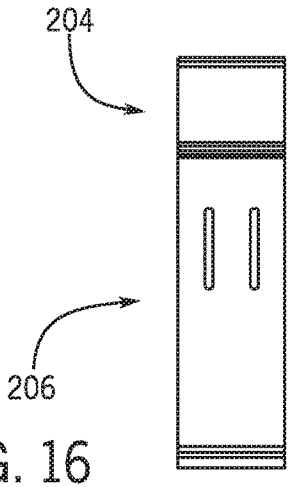
FIG. 16 is a front view of the center bracket shown in FIG. 15.
Figure 15:
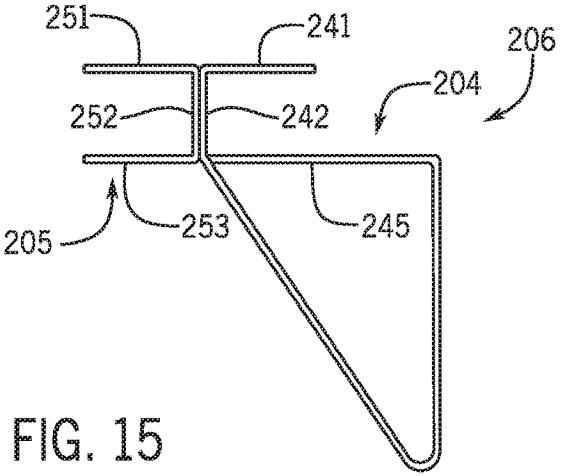
FIG. 15 is a side view of another exemplary embodiment of a center bracket for use with a bed frame assembly, such as the bed frame assembly shown in FIG. 11.
Figure 17:
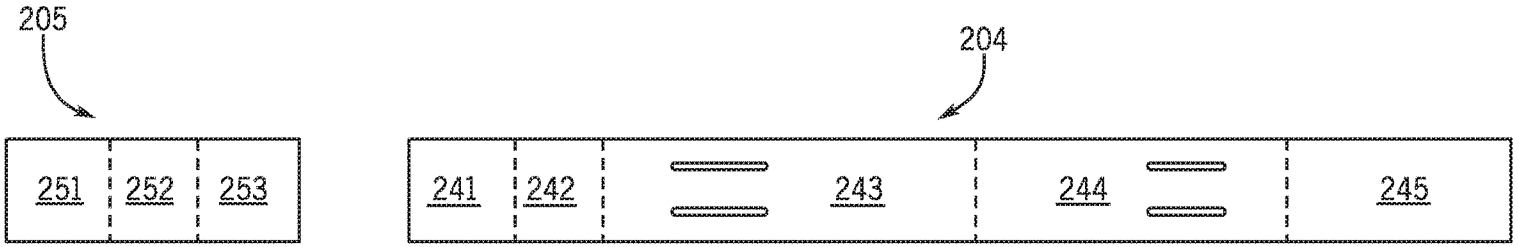
FIG. 17 is a plan view of a blank for use in forming the center bracket shown in FIG. 15.

Each center bracket 206 of the bed frame assembly 201 is configured to be coupled between two adjacent planar members 102 to support the two planar members 102 of the bed frame assembly 201. FIGS. 11 and 15-17 illustrate an exemplary embodiment of the center bracket 206. FIGS. 11, 15 and 16 illustrate the center bracket 206 in a formed configuration, while FIG. 17 illustrates the center bracket 206 prior to forming, as two blanks of material (e.g., steel or other suitable material). As shown, each center bracket 206 includes a first portion, which is configured the same as the end bracket 204, and a second portion 205 coupled (e.g., welded, fastened) to the first portion. As shown, the second portion 205 of the center bracket 206 includes two spaced apart fingers 251, 253 extending away from an arm 252. According to one example, the second portion 205 is a unitary member, such that two fingers 251, 253 and the arm 252 are integrally formed from a single piece of material (e.g., a single flat blank of steel or other suitable material) through any suitable forming process, such as stamping process (e.g., using a progressive die, transfer die, or other suitable process). However, the fingers 251, 253 and the arm 252 of the second portion 205 may be separate elements that are coupled together via welding and/or fasteners.

The arm 252 of the second portion 205 of the center bracket 206 is configured generally as a flat member, such as to allow the arm 252 to be coupled to the arm 242 of the first portion. The arm 252 may be welded (e.g., spot, laser, etc.) to the arm 242 such that the center bracket 206 is one bracket after welding. The arm 252 may be coupled to the arm 242 using other processes and/or elements (e.g., fasteners).

The first (e.g., upper) finger 251 of the second portion 205 of the center bracket 206 may extend from an end (e.g., upper end) of the arm 252 in a direction away from the first portion of the center bracket 206. As shown, the first finger 251 is generally coplanar to the finger 241 of the first portion of the center bracket 206. The second (e.g., lower) finger 253 of the second portion 205 of the center bracket 206 may extend from an end (e.g., lower end) of the arm 252 in a direction away from the first portion of the center bracket 206. As shown, the second finger 253 is generally coplanar to the base 245 of the first portion of the center bracket 206. Thus, the second portion 205 of the center bracket 206 forms a second C-shaped section, which may be a mirror opposite to the first C-shaped section formed by the first portion of the center bracket 206. The first and second C-shaped sections of the center bracket 206 are configured to receive and support two adjacent planar members 102 of the bed frame assembly 201.

Since the first portion of the center bracket 206 is configured the same as the end bracket 204, the remaining elements/features of the first portion are configured the same as described above for the end bracket 204 (and are not described now to avoid duplication). It is noted that by utilizing the end bracket 204 as a portion of the center bracket 206, the cost and complexity of the bed frame assembly may advantageously be reduced. For example, the cost of tooling of the components may be reduced by utilizing the end bracket 204 as a portion of the center bracket 206.

The bed frame assembly 201 may include one or more fixing members, such as tensioning straps, that are configured to help secure the bed frame assembly together when assembled. For example, the strap 108 described above may be used. Other connecting members may be used with the assembly 201.

The bed frame assemblies, as disclosed in this application, are modular in nature to be able to be used with different sized beds. The modular nature of the assemblies allows for the assemblies to advantageously be disassembled into relatively small and light weight components to be easily transportable. The bed frame assemblies, as disclosed in this application, also are relatively less complex systems, such as to advantageously be assembled/disassembled without the need for tools. The bed frame assemblies, as disclosed in this application, also are aesthetically pleasing and may be made from different materials (e.g., woods, metals) to tailor the assemblies for individual taste. Another advantage of the bed frame assemblies, as disclosed in this application, is they are very portable (e.g., easy to move), which make them particularly advantageous, for example, for people living in cities and moving between residences (e.g., apartments) more frequently. The bed frame assemblies of this application including relatively flat, smaller components further enhance the portability/transportability of the assemblies. Another advantage of the bed frame assemblies, as disclosed in this application, is the components of the assemblies are easy to replace, such as should a component of the assembly break. Yet another advantage is that the brackets can be used with other materials to build a platform (i.e., the brackets can be sold without the planar members to further reduce the cost of the assemblies). For example, the brackets can be assembled with regular plywood, a door, or any other suitable flat member obtained by the customer, such as from a home improvement store.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

The terms "coupled," "connected," and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

The construction and arrangement of the elements of the bed frame assemblies, and components thereof, as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements, the position of elements may be reversed or otherwise varied, and the nature or number of discrete elements or positions may be altered or varied.

Additionally, the word "exemplary" is used to mean serving as an example, instance, or illustration. Any embodiment or design described herein as "exemplary" is not necessarily to be construed as preferred or advantageous over other embodiments or designs (and such term is not intended to connote that such embodiments are necessarily extraordinary or superlative examples). Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the appended claims.

Other substitutions, modifications, changes and omissions may also be made in the design, operating conditions and arrangement of the various exemplary embodiments without departing from the scope of the present invention. For example, any element/component (e.g., bracket, planar member, strap, etc.) disclosed in one embodiment may be incorporated or utilized with any other embodiment disclosed herein. Also, for example, the order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments without departing from the scope of the appended claims.

What is claimed is:

1. A bed frame assembly comprising:

a first planar member configured to support a bed;

a first end bracket coupled to a side of the first planar member, wherein the first end bracket is configured to contact a support surface to support the first planar member; and a connecting member detachably coupled to the first end bracket and configured to be adjusted to change a tension of the connecting member to secure the first end bracket to the first planar member;

wherein a portion of the first planar member is received in the first end bracket.

2. The bed frame assembly of claim 1, further comprising:

a second end bracket coupled to an opposite side of the first planar member, wherein the second end bracket is configured to contact the support surface;

wherein the connecting member is detachably coupled to the second end bracket and is configured to secure the first and second end brackets to the first planar member upon tightening of the connecting member.

3. The bed frame assembly of claim 1, further comprising:

a second planar member positioned adjacent the first planar member;

a first center bracket disposed between the first and second planar members to couple the first and second planar members together; and a second end bracket coupled to the second planar member;

wherein the connecting member is detachably coupled to the second end bracket;

wherein the connecting member is configured to secure the first and second end brackets to the first and second planar members, respectively, upon tightening of the connecting member; and wherein the first center bracket and the second end bracket are each configured to contact the support surface.

4. The bed frame assembly of claim 3, wherein the first end bracket is coupled to an outer side of the first planar member and the second end bracket is coupled to an outer side of the second planar member.

5. The bed frame assembly of claim 1, further comprising:

a second planar member positioned adjacent the first planar member;

a third planar member positioned adjacent the second planar member;

a first center bracket disposed between the first and second planar members to couple the first and second planar members together;

a second center bracket disposed between the second and third planar members to couple the second and third planar members together; and a second end bracket coupled to the third planar member;

wherein the connecting member is detachably coupled to the second end bracket;

wherein the connecting member is configured to secure the first and second end brackets to the first and third planar members, respectively, upon tightening of the connecting member; and wherein the first center bracket, the second center bracket, and the second end bracket are each configured to contact the support surface.

6. The bed frame assembly of claim 5, wherein the first end bracket is coupled to an outer side of the first planar member and the second end bracket is coupled to an outer side of the third planar member.

7. The bed frame assembly of claim 1, wherein the first end bracket comprises:

a base configured to support the first planar member;

a leg extending downwardly from the base and configured to contact the support surface; and an arm extending upwardly from the base and configured to limit a relative movement between the first end bracket and the first planar member.

8. The bed frame assembly of claim 7, wherein the leg extends generally perpendicular to the base.

9. The bed frame assembly of claim 7, wherein the first end bracket further comprises a finger extending from the arm generally parallel to the base, wherein the finger, the arm, and a portion of the base define a generally C-shaped section configured to receive and retain a portion of the first planar member.

10. The bed frame assembly of claim 7, wherein the first end bracket further comprises a foot disposed on an end of the leg, wherein the foot is configured to rest on the support surface to support the bed frame assembly.

11. The bed frame assembly of claim 10, wherein the first end bracket further comprises a support extending between the foot and the base, wherein the support, the base, and the leg cooperatively define a closed section to provide increased strength for supporting a load.

12. A bed frame assembly comprising:

a first planar member;

a first end bracket coupled to a side of the first planar member, wherein the first end bracket comprises:

a base configured to support the first planar member;

a leg extending downwardly from the base and configured to contact a support surface to support the first planar member; and an arm extending upwardly from the base and configured to limit a relative movement between the end bracket and the first planar member; and a connecting member detachably coupled to the first end bracket and configured to be adjusted to change a tension of the connecting member to secure the first end bracket to the first planar member.

13. The bed frame assembly of claim 12, further comprising:

a second end bracket coupled to an opposite side of the first planar member, wherein the second end bracket is configured to contact the support surface;

wherein the connecting member is detachably coupled to the second end bracket and is configured to secure the first and second end brackets to the first planar member upon tensioning of the connecting member.

14. The bed frame assembly of claim 12, further comprising:

a second planar member positioned adjacent the first planar member;

a first center bracket disposed between the first and second planar members to couple the first and second planar members together; and a second end bracket coupled to the second planar member;

wherein the connecting member is detachably coupled to the second end bracket;

wherein the connecting member is configured to secure the first and second end brackets to the first and second planar members, respectively, upon tensioning of the connecting member; and wherein the first center bracket and the second end bracket are each configured to contact the support surface.

15. The bed frame assembly of claim 14, wherein the first end bracket is coupled to an outer side of the first planar member, and wherein the second end bracket is coupled to an outer side of the second planar member.

16. The bed frame assembly of claim 12, further comprising:

a second planar member positioned adjacent the first planar member;

a third planar member positioned adjacent the second planar member;

a first center bracket disposed between the first and second planar members to couple the first and second planar members together;

a second center bracket disposed between the second and third planar members to couple the second and third planar members together; and a second end bracket coupled to the third planar member;

wherein the connecting member is detachably coupled to the second end bracket;

wherein the connecting member is configured to secure the first and second end brackets to the first planar member and the third planar member, respectively, upon tensioning of the connecting member; and wherein the first center bracket, the second center bracket, and the second end bracket are each configured to contact the support surface.

17. The bed frame assembly of claim 16, wherein the first end bracket is coupled to an outer side of the first planar member, and wherein the second end bracket is coupled to an outer side of the third planar member.

18. The bed frame assembly of claim 12, wherein the first end bracket further comprises a foot disposed on an end of the leg, wherein the foot is configured to rest on the support surface to support the bed frame assembly.

19. The bed frame assembly of claim 12, wherein the first end bracket further comprises a support extending between the foot and the base, wherein the support, the base, and the leg cooperatively define a closed section to provide increased strength for supporting a load.

20. A bed frame assembly comprising:

a planar member having a first side, a second side, and a third side, wherein the first side is located between the second and third sides, and wherein the first side is configured to be oriented in a substantially horizontal direction to support a bed;

a first bracket removably coupled directly to the second side of the planar member;

a second bracket removably coupled directly to the third side of the planar member; and a connecting member detachably coupled to the first and second brackets and configured to be adjusted to change a tension of the connecting member to secure the first and second brackets to the planar member upon tightening of the connecting member;

wherein the second bracket is configured to be removed from the planar member upon loosening of the connecting member to allow for one or more additional planar members to be added to the bed frame assembly so as to reconfigure the bed frame assembly; and wherein the first end bracket and the second end bracket are each configured to contact a support surface to support the planar member.

* * * * *